United States Patent [19]

Hirschfeld

[11] 4,189,664

[45] Feb. 19, 1980

[54] POWER CONTROL UNIT FOR AUTOMATIC CONTROL OF POWER CONSUMPTION IN A LIGHTING LOAD

[76] Inventor: Richard L. Hirschfeld, 372 Bolinas Rd., Fairfax, Calif. 94930

[21] Appl. No.: 839,748

[22] Filed: Oct. 5, 1977

[51] Int. Cl.[2] ..... H05B 41/36; G05F 1/20

[52] U.S. Cl. ..... 315/297; 307/130; 315/182; 315/276; 315/307; 315/314; 323/43.5 S

[58] Field of Search ..... 315/86, 162, 174, 178, 315/291, 297, 307, 276, DIG. 4, 182, 314; 323/43.5 R, 43.5 S, 45; 307/130, 140, 141, 157

[56] References Cited

U.S. PATENT DOCUMENTS 3,419,790 12/1968 Guhn ..... 323/43.5

FOREIGN PATENT DOCUMENTS 2500492 7/1976 Fed. Rep. of Germany ..... 315/307

*Primary Examiner*—Eugene R. LaRoche
*Attorney, Agent, or Firm*—David E. Lovejoy

[57] ABSTRACT

The present invention is a power control unit and method of controlling power particularly for lighting loads such as incandescent lamps and fluorescent lamps. The power control unit is located between the power source and the load, typically between a circuit breaker and the lamps in a single circuit.

The power control unit functions to reduce the voltage delivered to the load and thereby to reduce the power consumed by the load. Reductions in power up to 10% or more are possible without any significant loss in lighting usefulness. Savings of up to 40% or more are possible when significant reductions in lighting output are acceptable.

14 Claims, 4 Drawing Figures

POWER CONTROL UNIT FOR AUTOMATIC CONTROL OF POWER CONSUMPTION IN A LIGHTING LOAD

BACKGROUND OF THE INVENTION

The invention relates generally to electrical control of power consumption on lighting loads, and other voltage-regulatable loads found such as in office buildings, industrial plants, schools and other buildings. The lighting loads to be controlled are both incandescent types and discharge types (such as fluorescent loads).

Prior art devices for regulating lighting loads include transformers connected in either a bucking or boosting circuit configuration. Such transformers normally form a static condition without any dynamic control. The absence of dynamic control either makes it difficult to maximize power saving or alternatively prevents normal operation when the voltage level drops too low or rises too high.

Prior art transformer devices which have controls such as variacs generally have not had adequate sensing circuits to provide for the desired control of power consumption in lighting loads.

Prior art devices for regulating lighting loads have also employed solid state elements. Such solid state elements are generally phased control devices which have a number of undesirable characteristics. For example, they tend to cause a significant amount of radio frequency interference (RFI). They are not generally usable with fluorescent lights without some special provision in the transformer of the fluorescent light. Since they are not generally usable with fluorescent lights, they cannot be used in a circuit which has a mixture of incandescent and fluorescent lights. Furthermore, generally there is no protection against voltage surges in the triac, the diac or other solid state control elements. This absence of protection frequently causes the solid state control elements to be damaged upon the occurrence of a burn out of the lamp.

Another factor to be considered is the existence of a large installed base of lighting circuitry. In order to be effective, it is desirable to have a power control unit which is utilizable in existing lighting facilities as well as in new facilities.

In view of the above background of the invention, there is a need for an improved power control unit for use in controlling lighting loads or other voltage-regulatable loads of all types.

SUMMARY OF THE INVENTION

The present invention is a power control unit and method of controlling power consumption in voltage-regulatable loads, particularly for lighting loads such as incandescent lamps and fluorescent lamps. The power control unit is located between the power source and the load, typically between a circuit breaker and the lamps in a single circuit.

The power control unit functions generally to reduce the voltage delivered to the load and thereby to reduce the power consumed by the load. Reductions in power up to 10% or more are possible without any significant loss in lighting usefulness. Savings of up to 40% or more are possible when significant reductions in lighting output are acceptable.

The power control unit of the present invention includes a controller for controlling operation as a function of voltage levels, delay times, clock times, and a number of external conditions. The controller connects to a switch unit to select one of a number of input voltage levels for connection to the load. The different input levels are typically provided by a multi-tap transformer.

In one embodiment, the input voltage level is automatically reduced at the output unless the input drops below a predetermined threshold, such as 104 volts. When the input is below the threshold, the output voltage to the load is not reduced but the input is applied directly to the load. In this manner, the power control unit reduces power consumption only when the input voltage is sufficiently high to permit a reduced voltage at the load which does not significantly inhibit operation of the lighting load.

In accordance with another feature of the present invention, the power control unit includes a delay unit for timing periods when the output voltage to the load is either maintained at the reduced level or maintained at a non-reduced level. In one embodiment, the output is maintained reduced for a majority of the time except that periodically, the output voltage is returned to a high level for short periods of time. Each time the output is returned to a high level, any fluorescent load on the line can be switched on. Once the fluorescent load is switched on, the voltage is again reduced. In this manner, fluorescent loads are operated at a reduced voltage while still permitting fluorescent loads to be turned on at frequent intervals when the output level is returned to a high level.

In one embodiment of the invention, the output voltage level is switched to the full input line voltage level for a period, for example 100 seconds, whenever the input voltage falls below a predetermined threshold value, such as 104 volts. The output load remains at the full input line value until the line voltage again exceeds the input threshold.

In accordance with other aspects of the present invention, a clock unit is provided for establishing predetermined times during each day, week or other period when the power control unit is to be switched to provide desired power reductions or non-power reductions.

In accordance with another feature of the present invention, a number of external control elements may be utilized in connection with the power control unit. For example, a light sensitive photodetector is employed to signal when the light level in an area is above or below a desired level. Additionally, the power control unit connected in one circuit can be used through external controls to control a plurality of other similar circuits under the same control conditions. Still additionally, the power control unit can be interconnected as an input/output device of a master computer or other control unit within a building.

The present invention achieves the objective of providing a power control unit for fluorescent and incandescent loads. The present invention enables fluorescent loads to be started even when significant reductions in voltage are utilized. With reduced voltage, transformers in fluorescent loads are operated cooler and therefore have an extended life. Also the lower voltage on incandescent loads extends their life. These and other features of the present invention enable each circuit load to be efficiently managed by the power control unit.

In accordance with the above summary, the present invention achieves the objective of providing an improved power control unit for controlling power consumption in voltage-regulatable loads.

Additional objects and features of the invention will appear from the following description in which the preferred embodiments of the invention have been set forth in detail in conjunction with the drawings.

DETAILED DESCRIPTION

Figure 1:
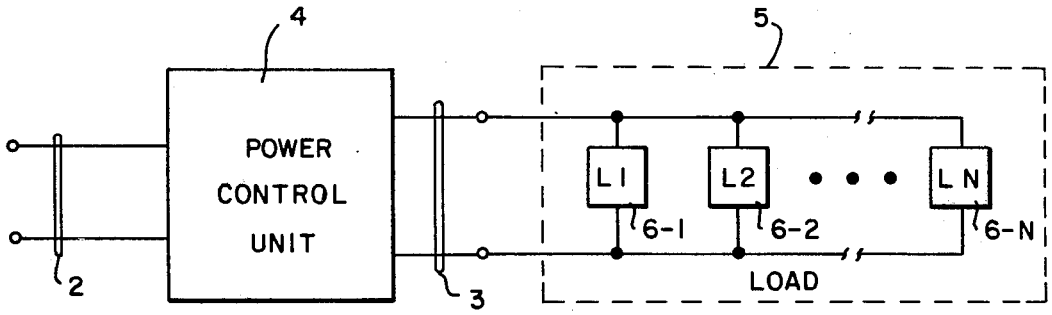
FIG. 1 depicts an electrical block diagram representation of the power control unit of the present invention located in a circuit between the input terminals which provide a source of power and the load.

In FIG. 1, the power control unit 4 has input lines 2 and output lines 3. For a typical incandescent lamp circuit, the input lines 2 connect to a nominal line voltage of 115 volts. For a typical fluorescent lamp circuit the input lines 2 connect to a nominal line voltage of 277 volts. Of course, any line voltage may be employed. The output lines 3 from the power control unit 4 connect to a load 5. The load 5 includes a plurality of incandescent or fluorescent lamps 6-1, 6-2, . . . , 6-N connected in parallel across the output lines 3. The load 5 is typically the lighting circuit in an office building or other typical lighting load. The power control unit 4 functions to reduce or increase the voltage level on lines 2 to produce a reduced or increased voltage on lines 3. A power reduction occurs in the load whenever the output on lines 3 is reduced relative to that on the input lines 2.

Figure 2:
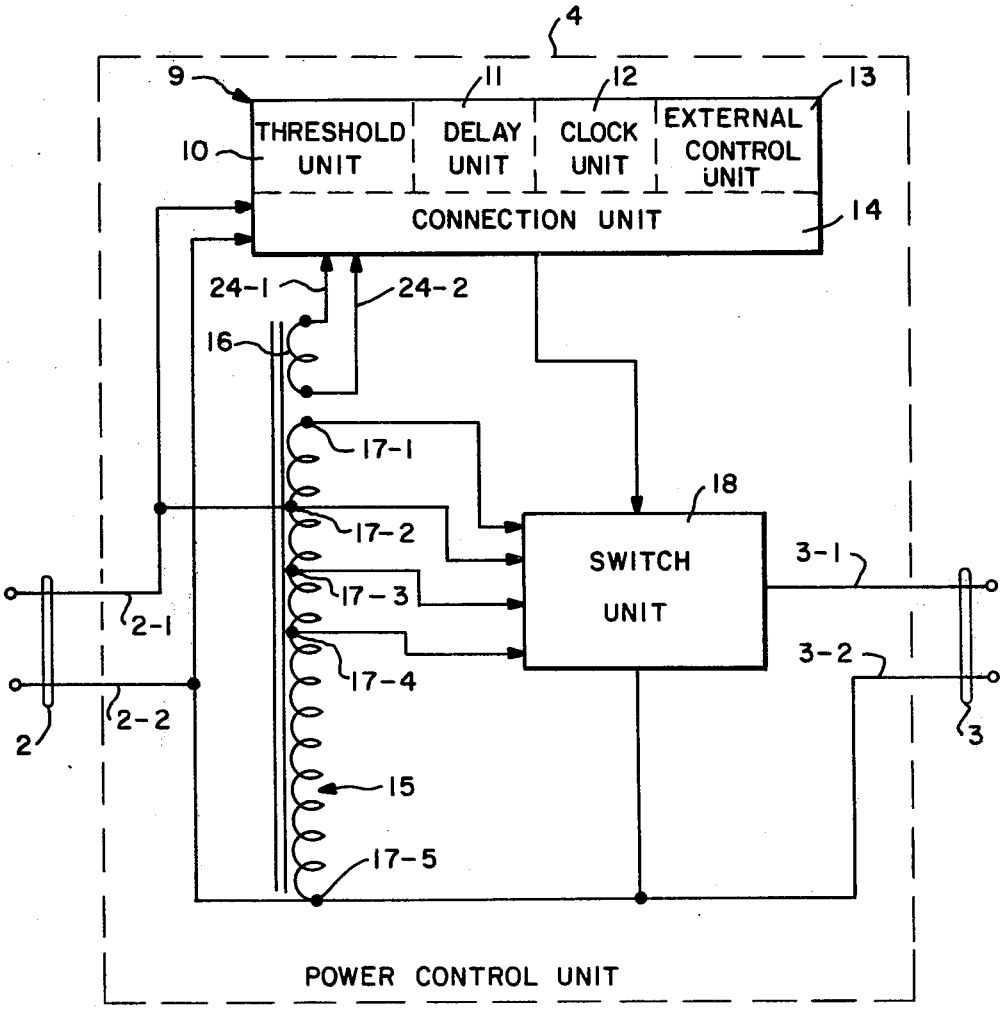
FIG. 2 depicts an electrical schematic block diagram representation of the power control unit of FIG. 1.

In FIG. 2, the power control unit 4 of FIG. 1 is shown in further detail.

In FIG. 2, the input lines 2, including lines 2-1 and 2-2, connect to a conventional autotransformer 15 at transformer taps 17-2 and 17-5, respectively. The windings of transformer 15 are selected so that the output on tap 17-1 is higher than the input voltage at tap 17-2 by approximately ten percent. For example, if the input on lines 2 is 115 volts then the output from tap 17-1 is approximately 127

In a similar manner, the output on tap 17-3 is approximately ten percent less than the voltage on tap 17-2 and the output on tap 17-4 is approximately forty percent less than the voltage on tap 17-2. The separate winding 16 is used for a separate control power source, typically 24 volts, as will be described hereinafter.

In FIG. 2, the taps 17-1, 17-2, 17-3 and 17-4 are connected to the switch unit 18. The switch unit 18 is operable, when actuated, to connect any one of the taps 17-1 through 17-4 to the output line 3-1. The voltage between the output lines 3-1 and 3-2 is, therefore, selected as the voltage on any one of the taps 17-1 through 17-4.

Control over the switch unit 18 is maintained by the controller 9. Controller 9 typically includes a threshold unit 10, a delay unit 11, a clock unit 12, an external control unit 13, and a connection unit 14.

The units 10 through 13 are internally interconnected by the connection unit 14. Unit 14 also provides outputs to control the switch unit 18. The controller 9 receives the input line voltage from the lines 2 and the control voltage from the winding 16. Also, the external control unit 13, in some embodiments, receives inputs from or provides outputs to external devices. The external devices include a photodetector for sensing light levels, a centralized building computer, and other similar devices.

Figure 3:
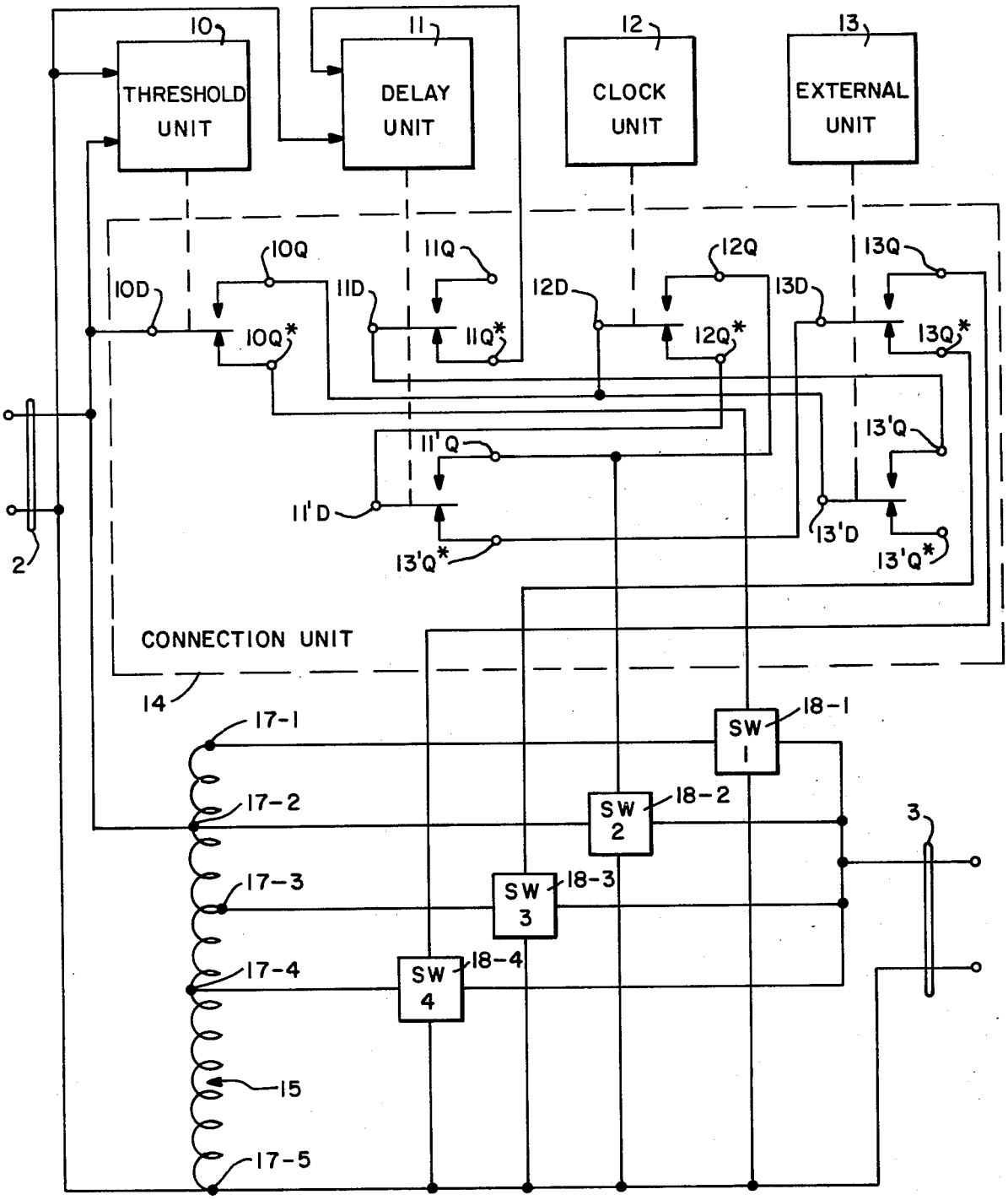
FIG. 3 depicts one embodiment of the power control unit of FIG. 2 with a particular connection unit interconnecting a threshold unit, a delay unit, a clock unit and an external unit.

In FIG. 3, further details of one embodiment of the power control unit 4 of FIG. 2 are shown. In that embodiment, under normal operation, the output voltage is reduced approximately 10%. In the event that the input voltage drops below a predetermined threshold, however, the output voltage is not reduced relative to the input voltage.

The FIG. 3 embodiment also provides a mechanism for reducing the output voltage by 40% of the input voltage when the external unit is energized to select such 40% reduction. Whenever the 40% reduction has been selected, the delay timer is actuated to insure that at periodic intervals the voltage returns to the input level so as to enable any fluorescent lamps in the load to be switched on at that periodic interval.

In FIG. 3, the threshold unit 10 is any conventional threshold device for sensing when the input voltage is above or below a threshold level. For example, such a sensor is sold by Guardian California Sensors, Model VS-1. Threshold unit 10 control relay contact points 10D, 10Q and 10Q* within the connection unit 14. When the input voltage to the threshold unit 10 is below a threshold level, for example 104 volts, the 10D terminal is in the normally closed position connected to the terminal 10Q*. When the threshold input on lines 2 exceeds 104 volts, the threshold unit 10 causes the 10D terminal to be switched to the 10Q terminal opening the connection between 10D and 10Q*.

In FIG. 3, the delay unit 11 is any conventional delay unit. One typical example is the delay unit sold by Guardian California Sensors for use with the threshold unit 10 as previously described. The delay unit 11 functions with no input voltage to connect the input terminal 11D to the normally closed output terminal 11Q*. When the voltage is applied on the input line to the delay unit 11, the connection between the terminals 11D and 11Q* is broken and a connection is made between terminals 11D and 11Q after a delay period which is preselectable. In one embodiment of the present invention, the delay is selected to be fifteen seconds. The delay unit 11 includes a second set of terminals 11'D, 11'Q, and 11'Q* which are switched in the same manner as the unprimed terminals.

The clock unit 12 is any conventional time of day clock which has one or more presettable contact terminals for switching. The terminals 12D, 12Q and 12Q* are shown.

The external unit 13 is any one of a number of devices for providing communication to or from external devices. The external unit 13 includes the contacts 13D, 13Q and 13Q* which are switchable in response to the same external stimulus or to control an external device. The operation of the FIG. 3 apparatus is described in connection with the following CHART I.

CHART I

| t | dt | INPUT-2 | 10Q* | 11Q* | 12Q* | 13Q* | SW | OUT-PUT-3 |
|---|---|---|---|---|---|---|---|---|
| t1 | | 0 | C | C | C | C | NONE | 0 |
| t2 | 1s | 115 | 0 | C | C | C | 3 | 104 |

-continued

CHART I

| t | dt | INPUT-2 | 10Q* | 11Q* | 12Q* | 13Q* | SW | OUT-PUT-3 |
|---|---|---|---|---|---|---|---|---|
| t3 | 100s | 115 | 0 | C | C | C | 3 | 104 |
| t4 | 1s | 115 | 0 | C | C | C | 3 | 104 |
| t5 | 100s | 115 | 0 | C | C | C | 3 | 104 |
| t6 | 6H | 115 | 0 | C | 0 | C | 2 | 115 |
| t7 | 3H | 115 | 0 | C | C | 0 | 4 | 69 |
| t8 | 100s | 115 | 0 | 0 | C | 0 | 2 | 115 |
| t9 | 1s | 115 | 0 | C | C | 0 | 4 | 69 |
| t10 | 100s | 115 | 0 | 0 | C | 0 | 2 | 115 |
| t11 | 1s | 115 | 0 | C | C | 0 | 4 | 69 |
| t12 | 50s | 108 | 0 | C | C | 0 | 4 | 65 |
| t13 | 30s | 95 | C | C | C | 0 | 1 | 105 |

In CHART I, the column "t" designates different sequential times which are arbitrarily selected to conveniently describe the operation of the FIG. 3 apparatus. The column "dt" defines the elapsed time since the last referenced time in the "t" column. For example, the amount of elasped time between t1 and t2 is one second (1 s) and the amount of elapsed time between t5 and t6 is six hours (6 H). The "INPUT-2" column designates the voltage across the input lines 2-1 and 2-2. Similarly, the column "OUTPUT-3" designates the output voltage across the output lines 3-1 and 3-2. The columns "10Q*", "11Q*", "12Q*" and "13Q*" each designate the open (O) or closed (C) condition of the indicated terminal. For example, at t1, the 10Q* terminal is indicated as closed meaning that it is connected to the 10D terminal. Obviously, the terminal 10Q is not connected at time t-1 to the 10D terminal. At time t2, the 10Q* is indicated as open meaning that 10Q* is not connected to terminal 10D and obviously meaning that terminal 10Q is connected to terminal 10D.

The column "SW" indicates which one of the switches 18 (from 1 to 4) is closed, if any.

In CHART I, at time t1, the input voltage level at terminals 2 and 0 volts. Under this condition, all of the contact terminals indicated in CHART I are normally closed and none of the switches 18 are activated. Therefore at time t1, there is no output voltage on lines 3.

Approximately one second after time t1 at time t2, 115 volts are applied to the input terminal 3. When this occurs, the threshold unit 10, set for a threshold of 104 volts, is energized and causes the terminal 10Q* to open and making a connection between terminals 10D and 10Q. The voltage level on terminal 10Q is connected through terminals 12D, 12Q*, 11'D, 11'Q*, 13D, and 13Q* to energize switch 18-3. Switch 18-3 is connected to the tap 17-3. Tap 17-3 has a voltage approximately 10% below the voltage on tap 17-2 so that the output at t2 on lines 3 is approximately 104 volts.

At time t3, approximately 100 seconds after t2 and at time t4 one second thereafter, and at t5 100 seconds thereafter, no change occurs and the output remains at 104 volts. This reduced voltage level of 104 volts is maintained until much later at time t6, six hours after t5, the clock unit 12 is timed to cause the 12Q* connection to be opened and the 12Q connection to be closed. The effect of the clock closure is to eliminate the reduced output voltage and cause the full innput voltage on lines 2 be applied at the output lines 3. Three hours after the t6 time, an external command through external unit 13 causes the terminal 13Q* to be opened. At this time the clock unit 12 has caused the connection to 12Q* to be closed. At t7, therefore, the switch 4 is selected to cause a 40% reduction in the output voltage relative to the input voltage. When the input voltage is 115 volts, the output voltage on lines 3 with a 40% reduction is then approximately 69 volts.

At t8, approximately 100 seconds after t7, the delay unit 11 is actuated to momentarily open the contacts 11Q* and 11'Q*. The delay unit 11 only remains thus actuated for a few milliseconds and then returns to its prior closed state. During the t8 period, however, switch 2 becomes selected applying the full input voltage on lines 2 to the output lines 3. Less than one second later, at time t9, the 11Q* terminal appears closed and the switch 4 is again selected to provide the 69 volt output at lines 3. The 69 volt level output is present for approximately 100 seconds until t10 when the delay unit 11 again times selection of switch 2 for a few milliseconds until again at t11 the 69 volt output again appears. The times t8 and t10 in CHART I, when the output voltage is at the full input level enables any fluorescent lamps in the load to be started. Since the period at full line voltage is short, it is not readily detected by observing lights in the load which are already on. Of course, full line on period may be for any duration desired and a delay unit may be used to time the full line on period.

This process of alternately returning a reduced voltage output to a higher level as occurs at t8 and t10, to enable fluorescent lamps to be started, is in accordance with one aspect of the present invention.

Again referring to CHART I, at time t12 it is assumed that, for some reason such as power company failure or problem, the input voltage has dropped to 108 volts. The 108 volt level, still is sufficient to enable switch 18-4 to be actuated and the output voltage drops proportionately from 69 to approximately 65 volts.

At time t13, however, the input voltage has dropped to 95 volts, which is below the 104 volt threshold of the threshold unit 10. Under this condition, the switch 10Q* becomes closed thereby automatically selecting switch 18-1 and applying an output voltage of 105 volts at lines 3 which is greater than the input level on lines 2.

FIG. 3 and representative examples of operation set forth in CHART I are not intended to be exhaustive of all of the variations which can be achieved in accordance with the present invention. The connection unit may be interconnected in many different ways in order to provide many different control functions for controlling the power which is to be delivered to the load.

Figure 4:
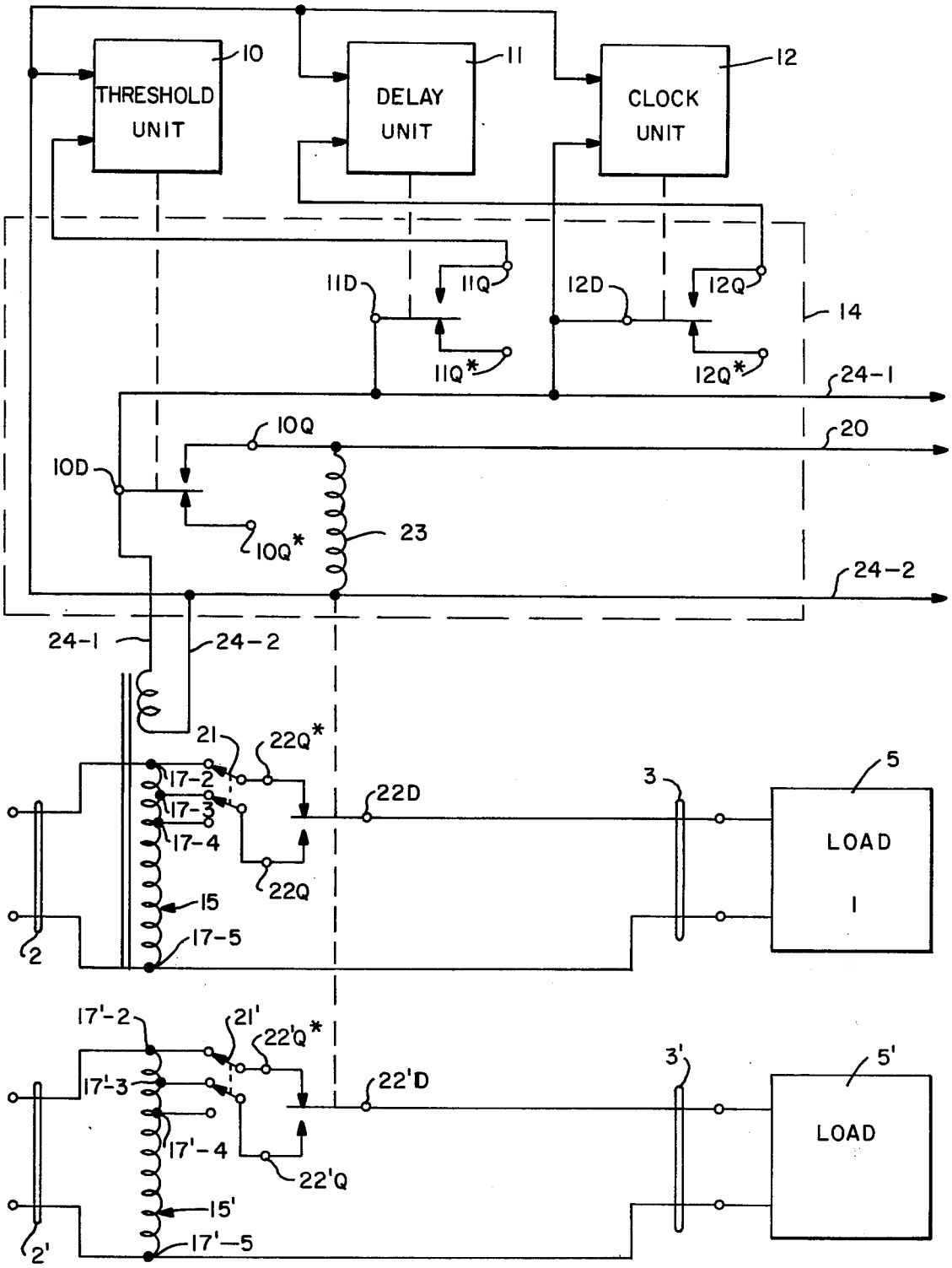
FIG. 4 depicts another unit with an alternate connection unit.

In FIG. 4, a single controller includes the threshold unit 10, a delay unit 11, a clock unit 12, and a connection unit 14. A first load circuit 5 is connected to receive power over input lines 2 and output lines 3 through a first transformer 15. Similarly, a second load circuit 5 is connected between the input terminals 2' and output terminals 3'.

The controller of FIG. 4 functions to control both the switches 22 and 22' for supplying power to loads 5 and 5' by operation of a relay 23. The switches 22 and 22' function to select voltage levels from the transformer taps 17-2, 17-3 and 17-4 and taps 17'-2, 17'-3 and 17'-4 for application to the output terminals 3 and 3'. The doublepole pull switches 21 and 21' are manually actuateable to select either the terminals 17-2 and 17-3 or the terminals 17-3 and 17-4 in one circuit and the similarly primed numbered terminals in the other circuit.

The operation of the FIG. 4 circuitry is as follows. Whenever the clock unit 12 is connected in the normally closed position, 12D connected to 12Q*, the controller is disabled and the relay 23 cannot be energized. With relay 23 not energized, the contacts 22 are in the normally closed position, 22D connected to 22Q*. With this connection, the input line voltage at tap 17-2 or at 17-3, depending upon the position of switch 21, is connected to the output line 3. The second circuit having primed numbers operates in the same manner.

At a time when the clock unit 12 is energized, the terminal 12D is connected to the terminal 12Q and initiates an input to the delay unit 11. Within a predetermined delay period after operation of the clock unit 12, the delay unit 11 causes the terminal 11D to be switched to the terminal 11Q, thereby connecting the input line 24-1 as a second input, along with line 24-2, to the threshold unit 10.

The voltage between the lines 24-1 and 24-2 is a control voltage which is normally 0.2 times the voltage on lines 2. Threshold unit 10 is set to operate at a threshold which is 10% lower than the maximum value on lines 24. The 10% lower threshold of unit 10 defines a threshold level which is 10% lower than the maximum voltage on lines 2. For example, the threshold unit 10 is set with a threshold of approximately 21 volts corresponding to a threshold of 104 volts at lines 2. If the voltage on lines 2 drops below 104 volts, then the voltage on lines 24 drops below the threshold of 21 volts. If the voltage on lines 24 is above the threshold, the terminal 10D is connected to the terminal 10Q causing the relay 23 to be energized. When the relay 23 is energized, the terminal 22D is connected to the terminal 22Q thereby selecting a voltage level, depending upon the position of switch 21, to provide a voltage reduction at the output lines 3. Whenever the voltage on lines 2 drops below the threshold, the threshold unit 10 is deactivated and the relay 23 causes the terminal 22D to be connected to the terminal 22Q* to provide the higher level voltage on output lines 3.

In a similar manner, the apparatus of FIG. 4 functions to reduce the output voltage on lines 3' for the second load circuit 5' at the same time as for load 5 under common control of one controller.

Also, the control signals on lines 24-1, 24-2 and 20 can be connected to remote relays (not shown) of the relay 23 type for controlling additional circuits (not shown) like the first and second circuits of FIG. 4. In this manner, a single controller can be utilized to control power consumption in many circuits.

The FIG. 4 apparatus is also effective on fluorescent type loads since the reduction in output voltage only occurs when the input is above the threshold at which such loads may be switched on.

FURTHER AND OTHER EMBODIMENTS

While the present invention has been described with respect to several different embodiments, it will be apparent that many additional variations are also possible. For example, the switches 21 in FIG. 4 may be controlled by the clock unit 12, by an additional clock unit, or by an external unit of the type previously indicated.

While the present invention has been described in connection with autotransformers, the invention also includes any kind of voltage source for producing different voltage levels. Conventional transformers having primaries and secondaries, solid-state devices or any other conventional type of voltage source may be employed. While a 115 volt input voltage and 104 volt threshold have been described, any input and threshold levels may be accommodated.

While the connection unit and switches of the present invention have generally been described in connection with relays and their associated contact terminals, it will be apparent that any type of switch and logical connecting units can be employed. For example, the connection unit and the output control signals can be formed using conventional solid-state logic gates in connection with power switches, either solid-state or otherwise.

While the invention has been particularly shown and described with reference to preferred embodiments thereof, it will be understood by those skilled in the art that the foregoing and other changes of form and details may be made therein without departing from the spirit and scope of the invention.

What is claimed is:

1. A power control unit for a lighting load which is connectable to a source of power, which source provides an input voltage level, for automatic control of power consumption in the lighting load, comprising,
   - means connected to said source for providing a number of different output voltage levels,
   - switch means for selecting one of said output voltage levels for connection to said load,
   - controller means for controlling said switch means to select one of said output voltage levels below said input voltage level to reduce power to said load, said controller means including first means for causing said switch means to select a higher-value one of said output voltage levels to said load.

2. The apparatus of claim 1 wherein said means connected to said source is a transformer.

3. The apparatus of claim 2 wherein said transformer is an autotransformer.

4. The apparatus of claim 1 wherein said first means includes a threshold unit for detecting when said input voltage is below a predetermined threshold.

5. The apparatus of claim 1 wherein said first means includes means for periodically selecting said higher-value one of said voltage levels.

6. The apparatus of claim 1 wherein said first means includes a threshold unit for detecting when said input voltage is below a predetermined threshold and includes a delay unit for timing periods of actuation of said switch means in response to a detection by said threshold unit.

7. The apparatus of claim 1 wherein said first means includes a clock unit for controlling the actuation of said switch means at predetermined times whereby lighting levels are adjusted to requirements.

8. The apparatus of claim 1 wherein said first means includes an external control unit for controlling the actuation of said switch means.

9. The apparatus of claim 1 wherein said first means includes a threshold unit for detecting when said input voltage is below a predetermined threshold and includes a delay unit responsive to said threshold unit for periodically providing timing periods when said higher-value one of said output voltage levels is selected.

10. A power control unit connectable to a source of power to receive an input voltage and to automatically control power consumption in a voltage-regulatable load where said load includes one or more fluorescent lamps, comprising,
   - voltage means connected to said source for providing from said input voltage a number of different voltages including a higher-value voltage capable of starting said fluorescent lamps and including one or more lower-value voltages for reduced power consumption in said load, switch means for selecting one of said different voltages for connection to said load, controller means for controlling said switch means to select one of said lower-value voltages to reduce power to said load, said controller means including first means causing said switch means to select said higher-value voltage whenever said input voltage is below a predetermined level and periodically switching between said higher-value voltage whereby said fluorescent lamps are periodically startable and one of said lower-value voltages, whereby power consumption in said load is reduced.

11. The apparatus of claim 10 wherein said voltage-regulatable load includes a plurality of circuits each connected to one or more different lamps, wherein said voltage means includes means for providing a number of different voltages in each circuit, and wherein said switch means includes means for selecting one of said voltages for each of said circuits, and wherein said controller means includes means for controlling said switch means in each circuit.

12. The apparatus of claim 10 wherein the ratio of the period during which said higher-value voltage is selected compared with the period during which said one of said lower-value voltages is selected is small.

13. The apparatus of claim 12 wherein said ratio is less than 0.01.

14. The apparatus of claim 10 wherein said voltage-regulatable load includes both fluorescent lamps and incandescent lamps.

* * * * *